US008978882B2

(12) United States Patent
Glass et al.

(10) Patent No.: US 8,978,882 B2
(45) Date of Patent: Mar. 17, 2015

(54) SWING TAG CARD HOLDER

(75) Inventors: Brett R. Glass, Overland Park, KS (US); Nicole E. Glass, Overland Park, KS (US)

(73) Assignee: Gifr Card Impressions, LLC, Kansas City, MO (US)

( * ) Notice: Subject to any disclaimer, the term of this patent is extended or adjusted under 35 U.S.C. 154(b) by 119 days.

(21) Appl. No.: 13/594,851

(22) Filed: Aug. 26, 2012

(65) Prior Publication Data

US 2013/0220879 A1 Aug. 29, 2013

Related U.S. Application Data

(60) Provisional application No. 61/527,138, filed on Aug. 25, 2011.

(51) Int. Cl.

| | |
|---|---|
| ***A45C 11/18*** | (2006.01) |
| ***B65D 85/00*** | (2006.01) |
| ***B65D 27/00*** | (2006.01) |

(52) U.S. Cl.

CPC ..... *B65D 85/00* (2013.01); *B65D 27/00* (2013.01); *Y10S 206/806* (2013.01)

USPC ..... 206/39.6; 40/124.06; 150/147; 206/39; 206/449; 206/806

(58) Field of Classification Search

USPC ..... 206/37, 39, 39.1, 39.5, 39.6, 449, 461, 206/767, 806; 40/124.06, 124.04; 229/67.4, 229/72, 92, 92.8; 235/375, 380, 487, 486; 150/147

See application file for complete search history.

(56) References Cited

U.S. PATENT DOCUMENTS

| | | | | |
|---|---|---|---|---|
| 2,681,677 | A * | 6/1954 | Poeltl | 206/39 |
| 5,038,926 | A * | 8/1991 | van der Toorn | 206/449 |
| 6,845,863 | B1 * | 1/2005 | Riley | 206/39 |
| 6,877,263 | B2 * | 4/2005 | Clark | 40/124.06 |
| 7,172,127 | B1 * | 2/2007 | Poland | 235/486 |
| 7,549,244 | B2 * | 6/2009 | Nelms et al. | 40/124.01 |
| 2005/0011776 | A1 * | 1/2005 | Nagel | 206/39 |
| 2007/0251994 | A1 * | 11/2007 | Kingsborough et al. | 235/486 |
| 2009/0045091 | A1 * | 2/2009 | O'Neill et al. | 206/449 |
| 2012/0222787 | A1 * | 9/2012 | Caron | 206/39 |
| 2013/0126371 | A1 * | 5/2013 | Glass et al. | 206/232 |

* cited by examiner

*Primary Examiner* — Luan K Bui
(74) *Attorney, Agent, or Firm* — Polsinelli PC

(57) ABSTRACT

An assembly for holding a transaction card, such as a gift card, upon a panel that pivots to be received within a pouch, pocket or sleeve to hold and retain the card during transport and storage.

8 Claims, 3 Drawing Sheets

SWING TAG CARD HOLDER

CROSS REFERENCE TO RELATED APPLICATIONS

This application claims the benefit of the prior filed, co-pending provisional application, Ser. No. 61/527,138, filed Aug. 25, 2011, incorporated by reference herein.

BACKGROUND OF THE INVENTION

This invention relates generally to transaction card holders and more particularly to an assembly for holding a transaction card, such as a gift card, upon a panel that pivots to be received within a pouch, pocket or sleeve.

Transaction cards, stored value cards, or gift cards, as they are commonly called based upon their intended use, have become popular gifts. Gift cards typically comprise a stored value card whereby a certain cash equivalent value is encoded upon a magnetic strip applied to the surface of the card. This stored value may be determined by the vendor prior to packaging and display for sale or, more commonly, is selected at the point of sale by the purchaser and loaded by the cashier using a magnetic card reader/writer. While popular, gift cards are typically provided with a generic and impersonal design, typically identifying the associated merchant for which the card may be used to purchase merchandise, and therefore are not personalized in view of the intended recipient.

Gift cards are often presented for sale on display racks in stores, each card or packet of cards being hung upon a display stand peg. A given area of a store will only support a certain number and size of display stands, given store traffic and other considerations, which makes allocation of display space an important marketing decision that may require selecting only certain high selling cards for display. Display of other items in the same store area will typically reduce the substantially finite space available for displaying gift cards and gift card packets.

In addition to the above considerations, gift card packets must fit within a set, allocated space in pre-existing displays. A gift card packet must not exceed 5.25" tall and 4" wide. These dimensions are an industry standard and are typically non-negotiable. In order to properly hang each gift card packet, the packet typically includes a J-hook hole (sombrero cut) with the exact dimensions of 1.875" wide by 0.5" high and be placed 0.1875" from the top of the packet. Presently, the above requirements pertain to approximately 95% of all gift cards and gift card packets that are sold at retail.

What is needed, therefore, is a device that displays a gift card for purchase when hung upon a display rack within a predetermined and allotted display space but that provides an enhanced gifting assembly after purchase, removal of the header panel, and installation of the gift card within the assembly.

BRIEF DESCRIPTION OF THE INVENTION

The purpose of this invention is to provide an assembly for holding a transaction card, such as a gift card, upon a panel that pivots to be received within a pouch, pocket or sleeve. In certain embodiments of the invention, the holder elements are designed to mimic the overall shape and appearance of a price or sale tag commonly used to mark merchandise.

An embodiment of a gift card holder assembly according to the present invention may include an insert having means for receiving and retaining a transaction card thereupon, a sleeve including a pocket for receiving the insert, the insert pivotable from an open position for display and use to a closed position for transport and storage. A further embodiment of a pivotable gift card holder assembly according to the present invention may include an insert pivotally connected to a sleeve about a pivot point so that the insert and the sleeve may pivot relative to each other and about the pivot point, the insert including means for receiving and removably holding a transaction card upon the insert. When the assembly is in use, a transaction card is removeably mounted to the insert. The assembly may also include an aperture sized and located in the insert to allow indicia, such as a barcode or magnetic strip, on the surface of the card proximate the insert (typically the back surface of the card) to be viewed, scanned or otherwise accessed through the aperture. A header panel, including an aperture therein for receiving the peg of a display stand, may extend from an end distal to the pivot point of either the insert or the sleeve, or from a side of either the insert or sleeve. Typically, the header is joined to the other element of the assembly along a perforation line so that it may be removed prior to giving the assembly, including a transaction card held within, to a recipient.

Other advantages of the invention will become apparent from the following description taken in connection with the accompanying drawings, wherein is set forth by way of illustration and example an embodiment of the present invention.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
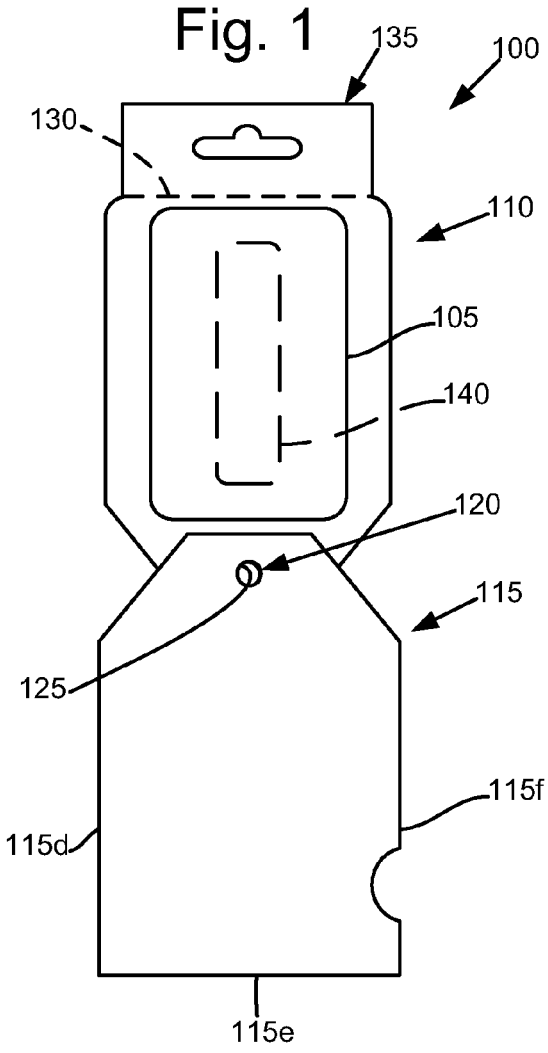
FIG. 1 is a front elevation showing the swing tag card holder in an open disposition for display upon a merchant display rack.

With reference to the figures, FIGS. 1-6 are illustration of one or more embodiments of a swing tag card holder 100 for holding transaction cards, such as a gift card 105. FIG. 1 is a front elevational view of the holder 100 showing the insert 110 in an upward, open disposition from the sleeve 115, as would be typical for display of the holder 100 upon a merchant display rack. The insert 110 and sleeve 115 are pivotally connected about a pivot point 120 that is typically defined by an aperture 125 passing through proximate portions of the insert 110 and the sleeve 115. The insert 110 and sleeve 115 are typically secured to one another at the pivot point 120 by a grommet (not shown) but may be secured using any device or structure that permits the insert 100 and sleeve 115 to pivot about the pivot point 120.

Figure 2:
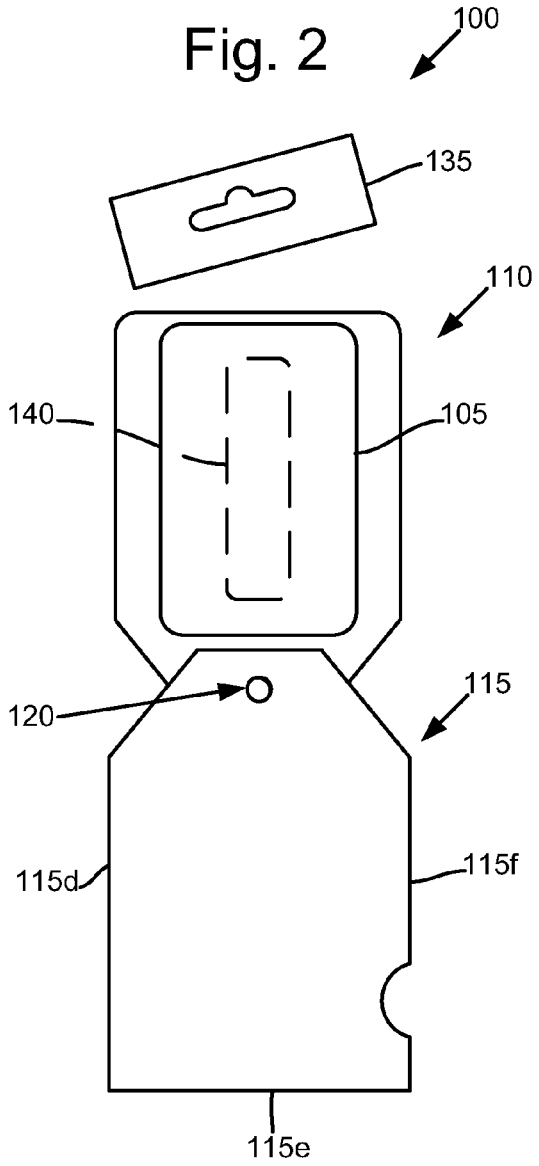
FIG. 2 is a front elevation showing the swing tag card holder in an open disposition and with the header panel removed.

The insert 110 typically includes a header panel 135 located and extending from at the end of the insert 110 distal to the pivot point 120. The header panel 135 is separable from the remainder of the insert 110 along a line of perforations indicated by broken line 130. FIG. 2 is a front elevation showing the holder 100 in an open disposition and with the header panel 135 removed. After purchase of the holder 100, which in the present embodiment includes a gift card 105 removably mounted to the insert 110, the header panel 135 is cut or torn off thereby reducing the size (length) of the insert 110 sufficiently to allow the insert 110 to pass into the confines of the sleeve 115.

As shown in several of the figures, the insert 110 may include a generally centrally located aperture 140 that allows indicia on the back surface of the gift card 105, such as a magnetic strip or barcodes, to be scanned or otherwise viewed or accessed.

Figure 3:
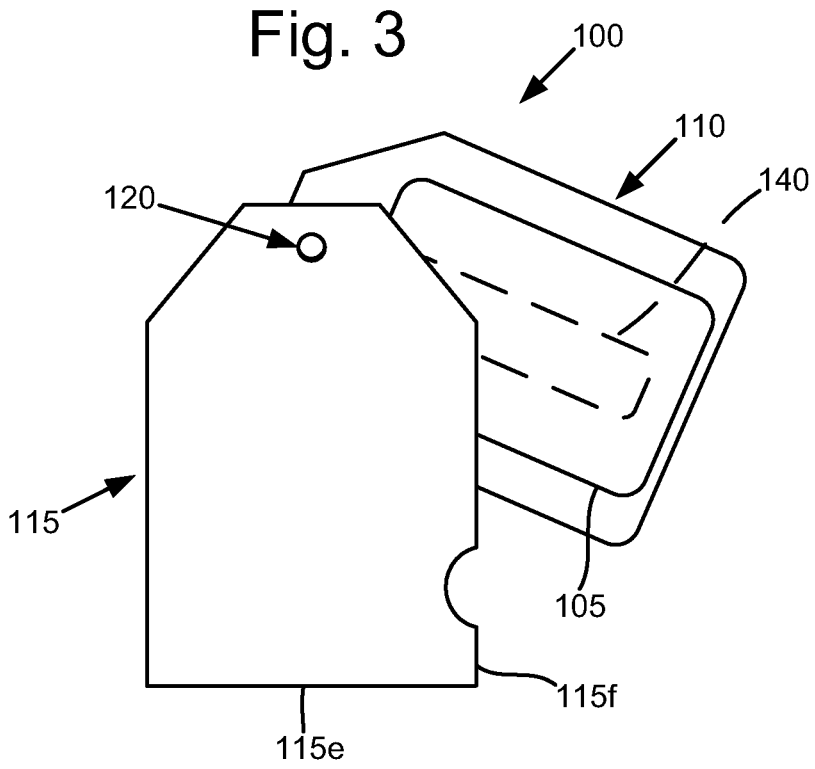
FIG. 3 is a front elevation showing the swing tag card holder insert pivoted to a partially closed position.
Figure 4:
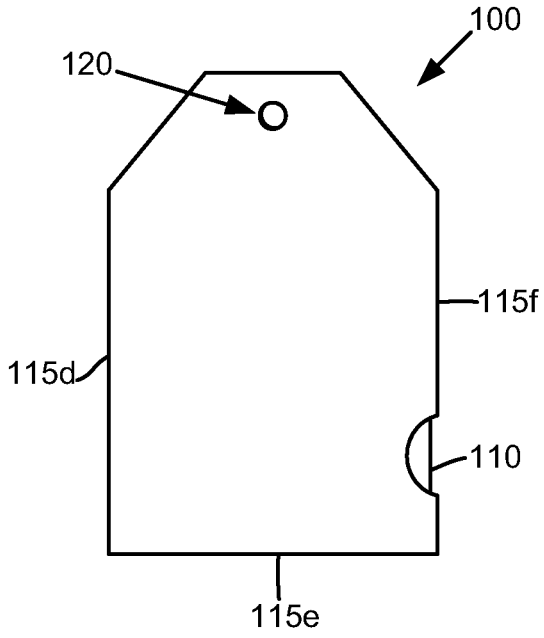
FIG. 4 is a front elevation showing the swing tag card holder insert pivoted to lie within the sleeve in a fully closed position.
Figure 5:
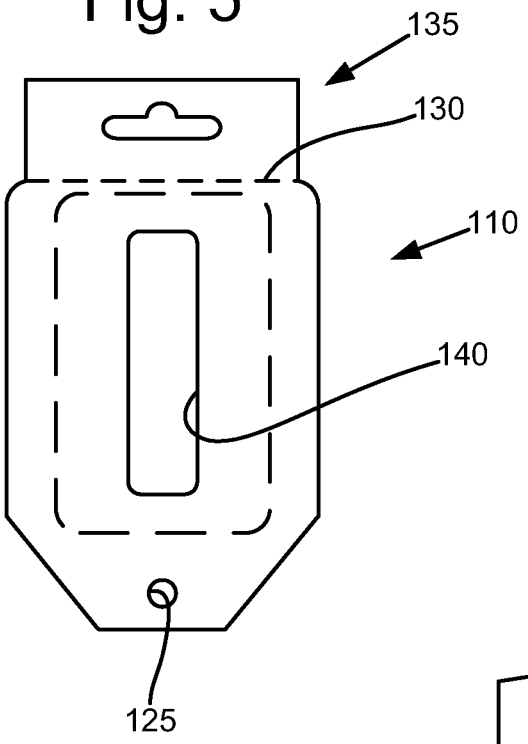
FIG. 5 is a front elevation of the insert prior to assembly of the holder.

FIG. 3 is a front elevation showing the holder insert 110 pivoted about pivot point 120 to a partially closed position. FIG. 4 is a front elevation showing the holder insert 110 pivoted fully to lie within the sleeve 115 in a fully closed position. FIG. 5 is a front elevation of the insert 110 prior to assembly of the holder 100.

Figure 6:
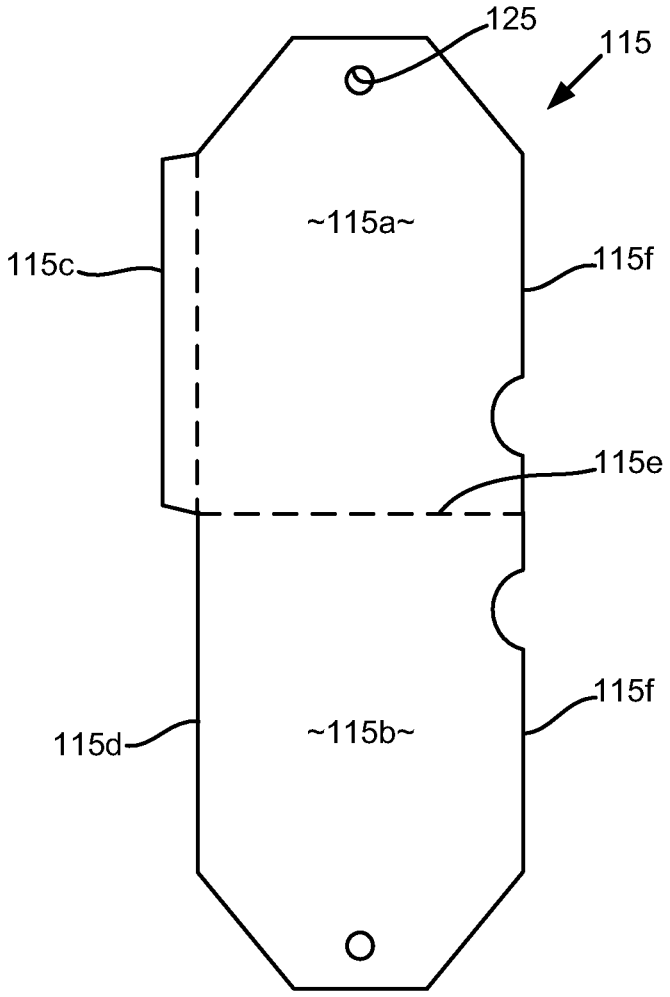
FIG. 6 is a plan view of material diecut to form the sleeve.

FIG. 6 is a plan view of material diecut to form the sleeve 115. As shown, the sleeve 115 may comprise two main panels 115*a* and 115*b*, which form the sides of the sleeve 115 when assembled and contain the insert 110 within the sleeve 115 when the holder 100 is closed. The sleeve 115 may also comprise a subpanel 115*c* that is used to join the main panels 115*a* and 115*b* to each other along side edge 115*d*, thereby closing the sleeve 115 at side edge 115*d*. Note that the sleeve 115 is also closed along bottom edge 115*e* by the fold between the adjoining main panels 115*a* and 115*b*.

To assemble the sleeve 115, adhesive is applied to subpanel 115*c*, which is then folded inward so that the adhesive contacts the inner surface of main panel 115*b*, thereby securing the main panels to each other along, and enclosing, sides 115*d* and 115*e*. Side 115*f* remains open to receive the insert 110. The main panels 115*a* and 115*b*, enclosed sides 115*d* and 115*e* and open side 115*f* thereby cooperate to form a pocket structure of the sleeve 115 size to receive and hold the insert 110. Side 115*f* may include a finger notch 150 therein to provide a ready means of grasping the portion of the insert 110 within the notch 150 to withdraw the insert 110 from the sleeve 115 as may occur prior to removal of the gift card 105 from the insert 110 by a gift recipient.

Having thus described the invention, what is claimed as new and desired to be secured by Letters Patent is:

1. A gift card holder assembly comprising:

an insert configured to receive and retain a transaction card, the insert including a header panel removable attached to the insert; and a sleeve including a pocket for receiving the insert, wherein the insert is pivotable from an open position for display and use to a closed position for transport and storage within the sleeve, wherein the insert has a first length that inhibits its insertion into the pocket when the header panel is attached to the insert, and wherein the insert has a second length that allows its insertion into the pocket when the header panel is removed from the insert, the second length being shorter than the first length.

2. A gift card holder assembly comprising:

an insert pivotally connected to a sleeve about a pivot point so that the insert and the sleeve may pivot relative to each other about the pivot point, the insert including means for receiving and removably holding a transaction card thereupon, the insert including a header panel removably attached to the insert, wherein the insert has a first length that inhibits its insertion into a pocket of the sleeve when the header panel is attached to the insert, and wherein the insert has a second length that allows its insertion into the pocket when the header panel is removed from the insert, the second length being shorter than the first length.

3. The assembly of claim 2, further comprising a transaction card removably mounted to the insert.

4. The assembly of claim 3, further comprising an aperture sized and located in the insert to allow indicia on the surface of the card proximate the insert to be at least one of viewed, scanned or accessed through the aperture.

5. The assembly of claim 2, wherein the header panel extends from an end of the insert distal to the pivot point.

6. The assembly of claim 2, wherein the header panel is removable attached to the insert using a line of perforations formed from a single piece of material.

7. The assembly of claim 2, wherein the header panel includes an aperture configured to receive a peg of a display stand.

8. The assembly of claim 4, wherein the indicia comprises at least one of a barcode or a magnetic strip.

* * * * *